United States Patent [19]

Coleman et al.

[11] 4,039,007

[45] Aug. 2, 1977

[54] CARPET WEAVING LOOMS

[75] Inventors: Kenneth John Coleman, Bridgnorth; Phillip John Brown, Bewdley; Howard John Stephen Watkins, Far Forest, near Kidderminster, all of England

[73] Assignee: Carpets International Limited, Kidderminster, England

[21] Appl. No.: 671,247

[22] Filed: Mar. 29, 1976

[30] Foreign Application Priority Data

Apr. 2, 1975 United Kingdom ..... 13489/75

[51] Int. Cl.[2] ..... D03D 39/02

[52] U.S. Cl. ..... 139/7 F

[58] Field of Search ..... 139/7 R, 7 A–7 G, 139/399, 400; 112/79 R, 79 A

[56] References Cited

U.S. PATENT DOCUMENTS

| | | | |
|---|---|---|---|
| 872,507 | 12/1907 | Greenwood | 139/7 F |
| 897,528 | 9/1908 | Greenwood | 139/7 F |
| 1,980,208 | 11/1934 | Kellog et al. | 139/7 F |
| 3,938,559 | 2/1976 | Dewhirst | 139/7 F |

FOREIGN PATENT DOCUMENTS

| | | | |
|---|---|---|---|
| 1,133,954 | 11/1968 | United Kingdom | 139/7 R |
| 1,261,120 | 1/1972 | United Kingdom | 139/7 F |
| 1,340,878 | 12/1973 | United Kingdom | 139/7 A |
| 24,086 of | 1892 | United Kingdom | 139/7 A |

*Primary Examiner*—James Kee Chi

*Attorney, Agent, or Firm*—Allegretti, Newitt, Witcoff & McAndrews

[57] ABSTRACT

An Axminster carpet loom is described which has improved cutting means for severing pile lengths of yarn from the pile yarns. In the past these have been severed by a pair of knives which operate rather like a pair of scissors but they require skill and time to set up. The present improved means include a serrated edge blade and one or more knives mounted on weft-wise reciprocatable carriages, the cutting edges being reciprocated over the serrations in the blade which locate the pile yarns during the cutting operation. Such knives can be relatively quickly and easily removed and replaced by fresh or reground knives when they need sharpening and so the loom can quickly be started again.

15 Claims, 4 Drawing Figures

CARPET WEAVING LOOMS

This invention relates to carpet weaving looms and in particular Axminster weaving looms.

BACKGROUND OF THE INVENTION

In a spool Axminster weaving loom each weft-wise row of pile is produced by weaving into the carpet the free ends of a row of carpet pile yarns which are carried would on a spool. Once the row of carpet pile has been secured in place by a weft, the yarns are severed to leave the pile woven into the carpet and release the spool which can then be replaced by a new spool which will have coloured pile yarns in a different order along it when weaving a patterned carpet.

The cutting of pile yarns can be achieved by a pair of cutting blades which extends generally weft-wise and are brought together in the fashion of the cutting edges of a pair of scissors so as to give a shearing action. From time to time these cutting blades need resharpening or replacement through wear and damage and this entails stopping the loom and removing the blades for grinding and the like. The resharpening operation is itself highly skilled and the subsequent reassembly of the blades on the loom is a long and skilled operation because of the accuracy required for good loom operation. In addition to the skill required, the lost operating time for the loom represents a very significant loss of production from an expensive piece of machinery. Further, the blades have a high replacement cost. While these disadvantages are highly significant for fairly narrow looms they markedly increase for broadlooms.

Also problems arise in the severing of the yarns in an Axminster gripper spool loom and an Axminster gripper loom before the severed yarns are woven into the carpet.

It is therefore an object of the invention to provide an Axminster carpet loom in which the cutting of the pile yarns is effected in a manner which simplifies the maintenance of the loom.

SUMMARY OF THE INVENTION

According to the invention there is provided an Axminster carpet loom having, for severing the pile yarns, a serrated-edge blade whose serrations are arranged to engage the pile yarns to locate them during cutting, at least one carriage which is reciprocable weft-wise, and a knife carried by the or each carriage across the serrations of the blade to sever the pile yarns trapped by the serrations.

The knife can be arranged to be readily demountable from the carriage and so it can be relatively simple and quick operation to remove it from the loom for replacement or sharpening. The carriage need not be removed from the loom or the cutter unit of the loom and so it can remain located accurately with regard to the serrated-edge blade which will itself normally extend weft-wise across the loom. Accordingly provided steps are taken to see that the cutting edge of the new or resharpened knife is remounted accurately relatively to the carriage, the new or resharpened knife will be accurately positioned and aligned for cutting yarns without further difficulty. Therefore knifes can be made interchangeable with one another so that the worm knife can be removed and replaced with a sharpened knife and the loom and cutter units can quickly start-to work again while the worn knife is being accurately resharpended.

It is preferred for the knife to be mounted in a holder and for this holder to have locating means whereby it can accurately and reproducibly mounted on the carriage. This can for example be achieved by providing the holder and carriage with co-operating surfaces which, when the holder is fixed to the carriage and they are in contact, will then locate the holder and cutting edge accurately and simply. The cutting edge of the knife is desirably ground and set up relative to the holder in a jig and these operations can be completed away from the loom while it is working. Then when a knife needs to be resharped or the like, the oil knife holder together with the knife it carries is demounted from the carriage and a fresh knife holder together with the knife are fixed in place quickly and accurately and the loom can be set to work again while the old knife is reground.

The knife edge is preferably ground on the end of an elongated blade so that, even when the sharpened end of the blade becomes worn away with use or regrinding, the blade can be advanced and reclamped in the holder. Then the sharpened edge will still be set at an accurate position and angle to the holder and carriage and be accurately positioned when again mounted on a carriage against the serrated edge blade.

The carriage or carriages can be physically driven weft-wise or in the direction across the yarns and to ensure that they travel accurately they can be constrained by a guide. By mounting the carriage or carriages on wheels or roller they can be made to move very freely and so can quickly complete the cutting operation.

The serrations of the serrated blade are preferably at a pitch which corresponds to the weft-wise spacing of the pile yarns. Thus preferably an individual pile yarn is trapped in each serration and this will assist in ensuring that the pile yarns remain correctly spaced weft-wise during weaving.

In order to ensure that the pile yarns are located and trapped in the serrations of the blade during cutting, a yarn locating bar is preferably provided which, during the cutting step, engages the yarns and pushes them towards the serrations. This yarn locating bar can conveniently be positioned above the serrated edge blade and knife between the latter and the spool during the cutting step, and then be retracted during the remaining weaving steps of the loom. This yarn locating bar is preferbly serrated since this gives even more positive location of the yarns during cutting. Preferably also the pitch of the serrations corresponds to the weft-wise spacing of the pile yarns.

The use of the invention need not required complete redesign of an Axminster carpet loom since the serrated edge blade, the carriage or carriages and the guides for the carriages can be fitted in place of the normally required cutting blades and the rear blade can be dispensed with completely or replaced by the yarn locating bar. Therefore in a very simple fashion an existing loom can be modified according to the invention while with new looms the invention need not require a redesign of anything but the yarn cutting operation of the loom.

The construction and operation of Axminster carpet looms is very well known in the art. The invention is applicable to all types of Axminster looms. Thus the invention is, for example, useful in gripper spool Axminster looms and gripper Axminster looms to sever the pile yarns from the spools the severed lengths then can be taken by grippers to the point of weaving and woven into the carpet. The invention is, however, particularly useful in a spool Axminster loom where the pile yarns are drawn off the spool and the ends of the yarns woven into the carpet before those ends are severed to release the spool.

DESCRIPTION OF THE DRAWINGS

The invention will now be illustrated, by way of example, with reference to the accompanying drawings, in which.

DESCRIPTION OF THE PREFERRED EMBODIMENTS

Figure 1:
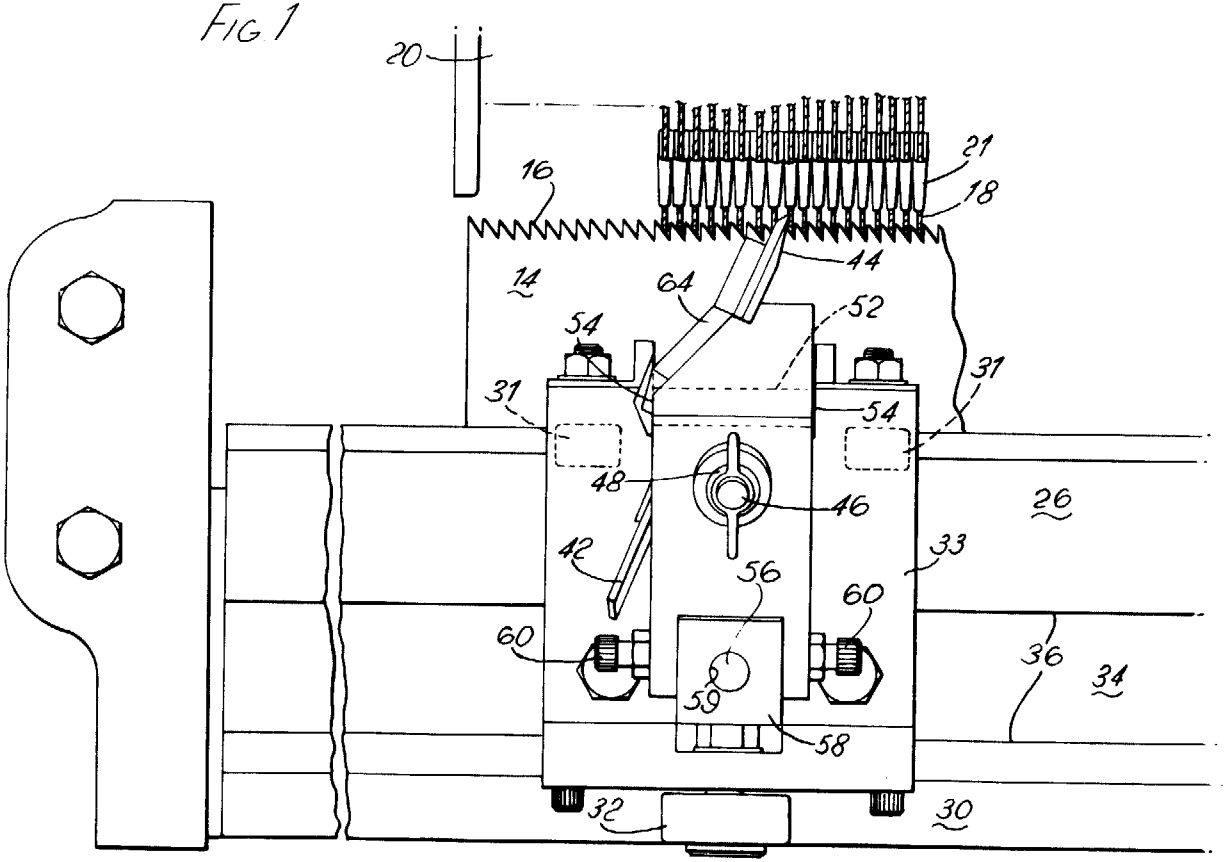
FIG. 1 is a plan detail of a spool Axminster carpet loom according to the invention.
Figure 2:
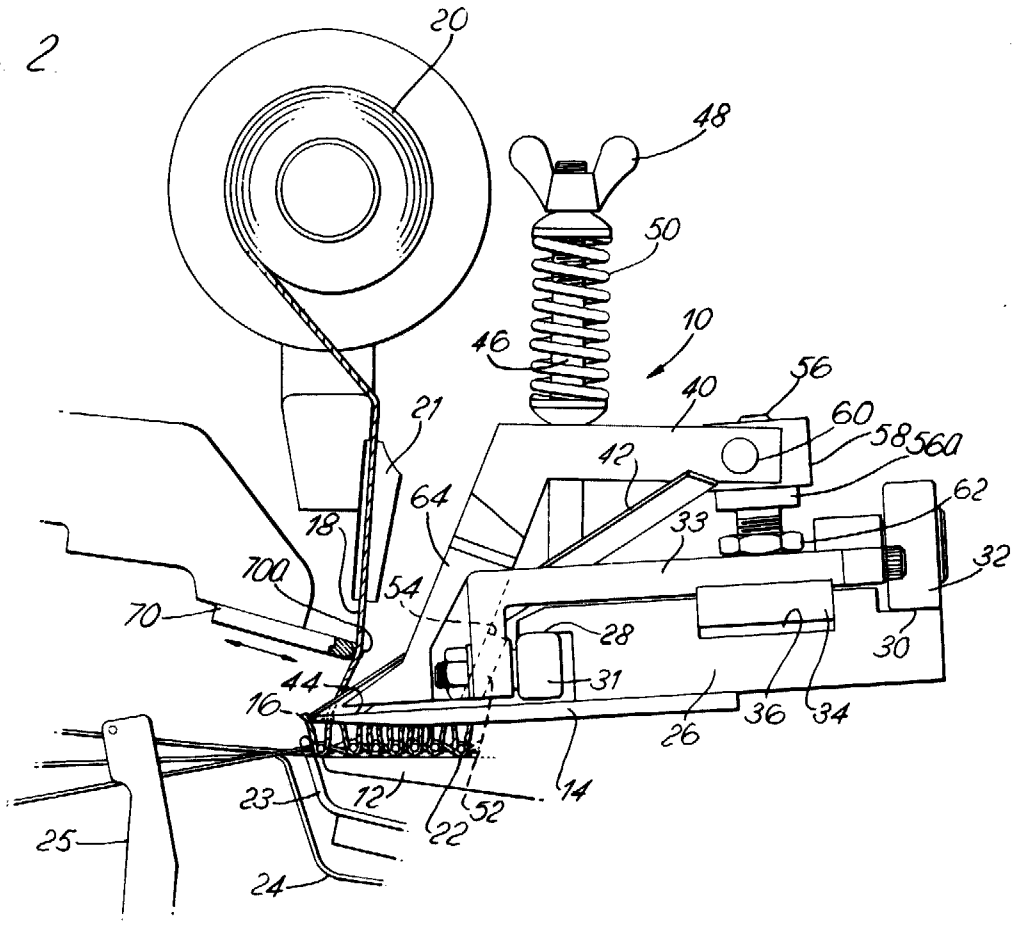
FIG. 2 is an elevational sectional detail of the loom shown in FIG. 1.

The carpet loom 10, detailed parts of which are shown in FIGS. 1 and 2 of the drawings is, apart from those parts relating to the cutter of the pile yarns, a conventional spool Axminster loom and these conventional weaving parts will not be described in detail since they and their function are well known. The parts shown in detail in the drawings relate to the cutting of the pile yarns and they will now be described.

Mounted above the breast plate 12 on which the woven carpet rests is a blade 14 having a serrated edge 16. The blade is mounted on the stock 26 which reciprocates during the weaving operation between an advanced position (shown in the drawings) where the pile yarns 18 are engaged and trapped in the serrations of the edge 16 and a retracted position to which the blade is moved during the weaving of the pile yarns. The lower edge of the blade is mounted the carpet pile height above the breast plate 12.

The pile yarns are held on a spool such as the spool 20 shown and guided by a tube frame 21 conventionally for a spool Axminster loom and are woven into the carpet 22 formed in a conventional manner. Also shown in FIG. 2 are the main comb 23 which positions and supports the row of pile yarns forming the carpet pile tufts being woven into the carpet, the guide comb 24 for the warps and the beat-up sley 25, all of which function conventionally in the weaving of the carpet 22.

The blade 14 is carried on the stock 26, the stock having rolling surfaces 28 and 30 along which the wheels 31 and 32, respectively, of one or more carriages 33 travel. These carriages 33 are constrained to move longitudinally and accurately along the stock relative the serrated edge 16, i.e., weft-wise, by a guide block 34 depending from the carriage 33 and engaging in a longitudinal groove 36 in the stock. They are moved weft-wise during the cutting of the pile yarns.

On the carriage 33 is mounted a knife holder 40 which carries a knife blade 42 having a sharpened cutting edge 44 which will sever the pile yarns trapped by the serrated edge 16. Through a bore in the knife holder passes a bolt 46 fixed to the carriage, while tightened on this bolder 46 is a nut 48 which compresses a spring 50 which urges the holder downwardly against the carriage. In this way the knife holder is securely held against the carriage but remains readily releasable when the knife blade needs resharpening. Instead of using the coil spring 50 shown, that spring could be replaced by a leaf or other type of spring provided the holder is securely held in position.

In order to position the knife holder 40 accurately relative the carriage it has a flat, longitudinally extending bearing strip 52 on its under-side which abuts the front edges 54 of the carriage, and a pivotably-mounted block 58 held in place by threaded bolts 60 which engage a bore (not shown) in the block 58. The block 58 has an upright bore 59 through it and the block 58 fits over a stud 56 which passes through the bore 59, the block resting on an abutment **56*a*. The stud is threaded and screwed into the carriage, a locking nut 62 being provided to secure it in position. For fine adjustment and alignment of the knife blade, the locking nut 62 is released and the stud 56 is rotated to raise or lower the abutment 56*a* and accordingly the block 58 relative the carriage, so causing fine pivoting adjustment about the engaged edges 52 and 54 and consequent fine adjustment of the cutting edge 44 relative the blade 14.**

The knife blade 42 is an elongated strip of hard cutting metal and is clamped to the holder by a clamping plate 64 and bolts not shown. Its cutting edge 44 is formed and sharpened in a jig (not shown). In this jig the knife holder 40 and blade 42 are held, after removal from the carriage and the cutting edge 44 ground down to a pre-set position relative the edge 52. Thus once the combined knife and holder are refixed on the carriage the edge becomes accurately located relative the blade without hightly skilled or tedius aligning and setting-up steps. In addition there is, of course, the advantage that, after sharpening, the combined knife holder and blade are interchangable and so can be fitted to any carriage 33. Thus, the loom can be given a fresh cutting edge and then can be returned to operation while the knife is resharpened and positioned away from the loom for later use on that or another loom.

In order to hold the pile yarns 18 in the serrations of the blade 14 during cutting, a yarn locating bar 70 is provided which is positioned in the forward position shown in FIG. 2 during cutting where it urges the yarns towards the serrations. This bar 70 has a serrated edge **70*a* contacting the pile yarns, so as to assist in the positive location weft-wise of the pile yarns. Preferably the pitch of the serrations both in the bar 70 and edge 16 are equal to the weft-wise spacing of the pile yarns. The bar 70 is retracted to the left in the direction shown in FIG. 2** during the remaining weaving steps of the loom in that it does not interfere with the weaving of the pile yarns into the carpet.

The operation of the loom 10 according to the invention differs only from a conventional loom in the cutting of the pile yarns. To effect this cutting step, the stock 26 moves to its forward position and the bar 70 advances to trap the yarns in the serrations in the blade 14. Next the carriages are reciprocated across the stock 26 and in the advancing movement of this recirprocation the knife edges 44 sever the yarns. Then the bar 70 and stock 26 retract.

The cutting operation is very simple and is sufficiently quick not to delay the other operations of the loom. Also, because the exchange of a knife 42 and holder 40 is a quick and simple operation involving only a short period of idleness for the loom, one can keep the edge 44 in excellent cutting condition by relatively frequent changes without signficantly long periods of idleness for the loom.

There may be one or more carriages 33 depending upon the width of the carpet 22 being produced. In this way one can limit the distance which each carriage has to travel during cutting. In the case of a broadloom, there will normally be several carriages 33 and all can be driven by the same drive so that they cut simultaneously.

Figure 3:
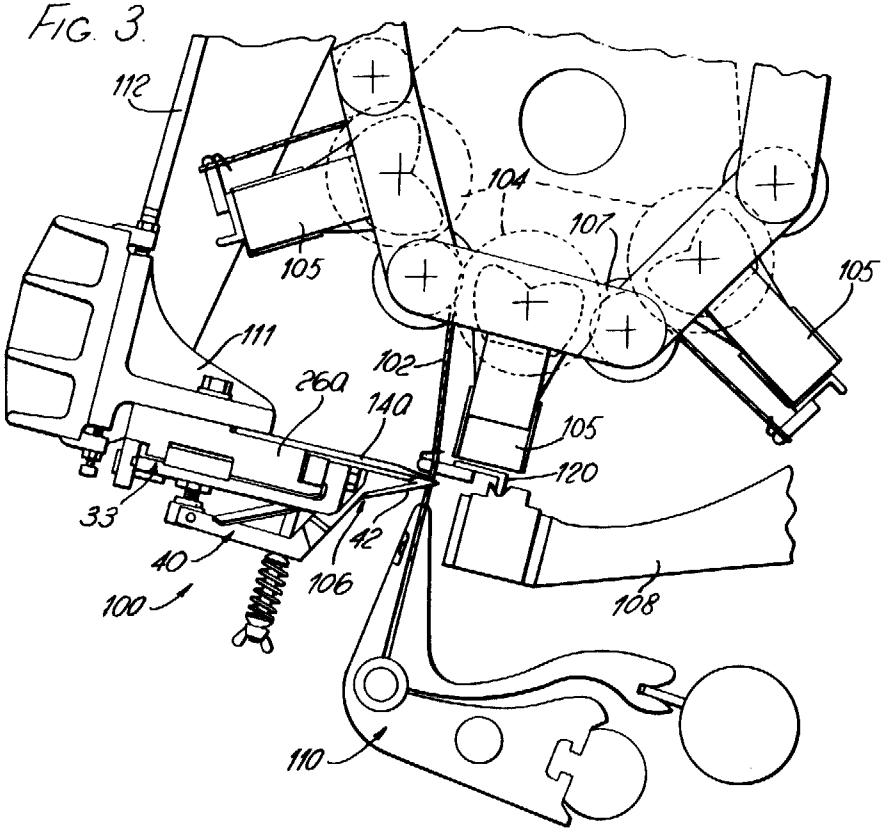
FIG. 3 is an elevational-sectional detail of the cutter unit of a spool gripper Axminster loom according to the invention.

The cutting unit 100 of a gripper spool Axminster loom is shown in FIG. 3. The cutter unit is conventional apart from the severing of the pile tufts from the pile yarns 102. Thus there are a number of conventional spools 104 and tube frames 105 carrying the yarns which are in turn presented by a chain conveyor 107 to a cutter 106 which will be described in due course. The severed pile tufts are gripped by a conventional gripper mechanism 110 which conveys the row of pile tufts to the weaving station of the loom (not shown) where they are woven into a carpet. The weaving steps of the loom are conventional and so will not be described.

The cutter 106 comprises a stock **26*a* which is supported by a cross member 111 and at either end by a pair of pivoted arms 112. These arms advance the cutter to the cutting position shown in FIG. 3 and then retract it during the advance of the next spool 104 by the conveyor 107. In the advance position, while the cutter 106 is severing the yarns 102, the associated spool 104 is positioned by a locating arm 108.**

The stock **26*a* is similar to the stock 26 and carries a serrated edge blade 14*a* and one or more carriages 33, knife holders 40 and knife blades 42, which are identical in construction and operation with those described in connection with FIGS. 1 and 2.**

The operation of the cutting unit 100 should be clear. The conveyor 107 advances the next spool 104 and tube frame 105 and they are then positioned by the locating arm 108 which contacts a guide pin 120 on the tube frame. The gripper mechanism 110 grips the ends of the pile yarns in its jaws and withdraws a length from the spool. Next the arms 112 pivot and move the stock **26*a* to its advanced position where the yarns are engaged by the serrations in the blade 14*a*. The carriage or carriages 33 are reciprocated along the stock and so that knife blades 42 sever the yarns trapped in the serrations of the blade 14*a* during the advancing stroke of the reciprocation. The gripper mechanism can then convey the severed yarns to the weaving station to be woven into the carpet, the arms 112 withdraw the stock 26*a* and the locating arm withdraws from the tube frame 105** so that the conveyor can advance one step to bring the next spool into position.

The use of the cutter 106 has the same advantages as described in connection with FIGS. 1 and 2 in that the operation of the loom need not be delayed while the knife blades are being sharpened or reground because fresh interchangeable knife blades 42 and holders 40 can be quickly and accurately fitted to the carriage and the loom restarted while the sharpening is taking place.

Figure 4:
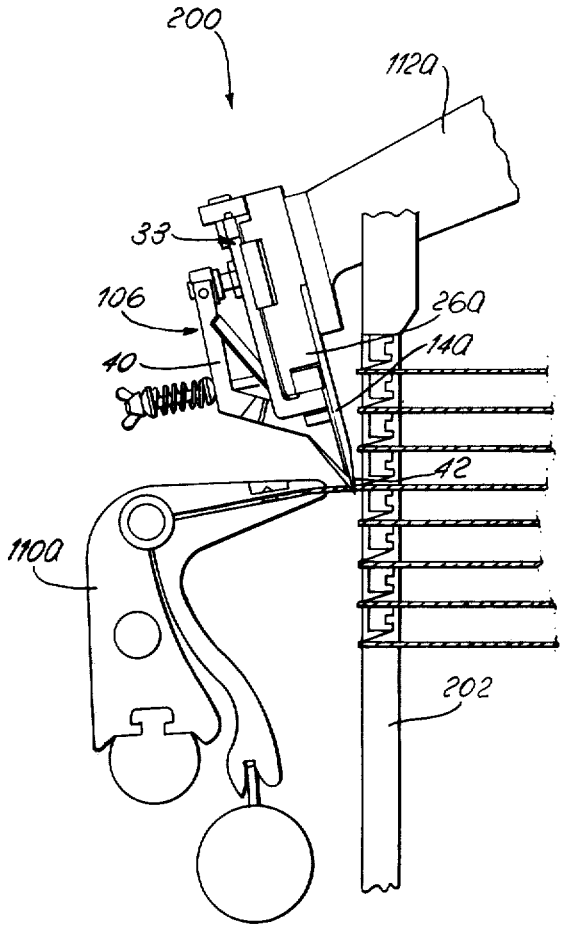
FIG. 4 is an elevational-section detail of the cutter unit of a gripper Axminster loom according to the invention.

The cutting unit 200 of a gripper Axminster loom shown in FIG. 4 is very similar to the unit 100 shown in FIG. 3 in that it comprises a cutter 106 including a stock **26*a* carried by a pair of pivoted arms 112*a*. The stock 26*a* again carries one or more carriages 33, knife holders 40 and knife blades 42, as well as a serrated edge blade 14*a*.**

The unit 200 has a gripper mechanism **110*a* similar in construction and operation to the unit 110 described in connection with FIG. 3, while rows of yarns are held by a yarn carrier 202, lengths of one row at a time being gripped and withdrawn by the gripper mechanism. The lengths of yarn withdrawn by the gripper mechanism 110*a* are severed by the cutter 106.**

The cutter 106 again has similar advantages to those described above in connection with FIGS. 1 to 3.

A latitude of modification, change and substitution is intended in the foregoing disclosure and in some instances some features of the invention will be employed without a corresponding use of other features. Accordingly it is appropriate that the appended claims be constructed broadly and in a manner consistent with the spirit and scope of the invention herein.

What is claimed is:

1. In an Axminster carpet loom having cutting means for severing pile yarns, said cutting means of the type including a serrated blade arranged to engage and locate the pile yarns during cutting; at least one carriage mounted on said loom for reciprocable movement in a substantially weft-wise direction; and a knife carried by the carriage, said knife being positioned for movement by the carriage across said blade to sever said pile yarns trapped by serrations of said blade, the improvement comprising:

a removable knife holder for said knife mounted on the carriage;

and locating means to accurately and reproducibly mount said holder on the carriage, said locating means comprising a locating surface on said holder, a mating surface on said carriage, and means for maintaining said surfaces in contact to thereby locate said holder accurately and reproducibly relative to said carriage and simultaneously maintain said knife in fixed, reproducible position relative to the serrated blade.

2. The improved loom of claim 1 wherein said carriage includes mounting pin means and said holder includes means cooperative with the mounting pin means.

3. The improved loom of claim 2 wherein said means cooperative with the mounting pin means comprise pivot connection means whereby the holder is pivotal.

4. The improved loom of claim 1 wherein said means for maintaining includes biasing means mounted on the carriage for biasing the holder onto said carriage, said surfaces being engaged to fix the holder in position relative to the carriage.

5. The improved loom of claim 1 including a knife which is removable from the holder whereby the knife may be removed and independently sharpened.

6. The improved loom of claim 1 wherein said holder includes means for rigidly holding the knife and for adjusting the extent of exposure of the knife.

7. The improved loom of claim 1 wherein said holder and knife are removable from and replaceable on the carriage.

8. The improved loom of claim 1 including mounting means on said carriage for receipt and holding of the holder, said mounting means being adjustable to thereby adjust the position of the holder and knife relative to the carriage and the serrated blade.

9. The improved loom of claim 1 including guide means cooperative with the carriage for guiding the carriage in a substantially weft-wise direction.

10. The improved loom of claim 1 including a yarn locating bar to engage the yarn and push said yarn toward the serrated blade during cutting of the yarn by the blade and knife.

11. The improved loom of claim 10 including means for retracting the locating bar from engagement position with the yarn.

12. The improved loom of claim 1 including rollers for mounting the the carriage on the loom, said loom including means for guiding the rollers in weft-wise reciprocation.

13. The improved loom of claim 5 wherein said knife is in the form of an elongated strip of cutting metal having a sharpened cutting edge.

14. The improved loom of claim 1 wherein said carriage includes an additional separate and adjustable mounting surface and wherein said holder includes means cooperative with the additional separate and adjustable mounting surface whereby a pair of cooperating surfaces on said holder and said carriage are defined to accurately and reproducibly locate and mount the holder and attached knife.

15. A spool Axminster carpet loom comprising, in combination:

a. weaving means for forming a carpet backing and for incorporating pile yarns into said backing to form an Axminster carpet, b. a set of spools each having pile yarns wound thereon, c. means for conveying said spools one by one to a weaving station where pile lengths of said pile yarns carried by said one spool are arranged to be woven weft-wise into said carpet to form a pile, d. a serrated-edge blade at said weaving station, said blade having serrations which are arranged to engage said pile yarns carried by said one spool, e. at least one carriage movable weft-wise, f. a knife holder for the carriage, said holder being mounted on the carriage, and having g. locating means to accurately and reproducibly mount said holder on the carriage, said locating means comprising a locating surface on said holder, a mating surface on said carriage, and means for maintaining said surfaces in contact to thereby locate said holder accurately and reproducibly relative to said carriage and maintain said knife in fixed, reproducible position relative to the serrated blade, h. a knife carried by the holder, and i. means for reciprocating said carriages in a weft-wise direction, whereby said knife passes across the serrations of said blade to sever pile yarns trapped by said serrations to give said pile lengths.

* * * * *